US006932450B2

(12) United States Patent
Mandel

(10) Patent No.: US 6,932,450 B2
(45) Date of Patent: Aug. 23, 2005

(54) REFRIGERATOR CONTENTS VIEWING SYSTEM

(75) Inventor: Sheldon W. Mandel, East Galesburg, IL (US)

(73) Assignee: Maytag Corporation, Newton, IA (US)

( * ) Notice: Subject to any disclaimer, the term of this patent is extended or adjusted under 35 U.S.C. 154(b) by 34 days.

(21) Appl. No.: 10/246,427

(22) Filed: Sep. 19, 2002

(65) Prior Publication Data

US 2004/0056574 A1 Mar. 25, 2004

(51) Int. Cl.[7] ..... A47B 96/02
(52) U.S. Cl. ..... 312/408
(58) Field of Search ..... 312/401, 404, 312/407, 408, 116, 224, 226; 211/144, 150; 62/440

(56) References Cited

U.S. PATENT DOCUMENTS

| | | | | |
|---|---|---|---|---|
| 806,550 A | * | 12/1905 | Marstall | 312/226 |
| 1,753,594 A | * | 4/1930 | Bond | 312/116 |
| 2,346,368 A | | 4/1944 | Edwards | |
| 2,490,413 A | | 12/1949 | Burtis | |
| 2,528,916 A | | 11/1950 | Shreve | |
| 2,594,066 A | | 4/1952 | Pabst | |
| 2,687,621 A | * | 8/1954 | Fitzgerald | 62/150 |
| 3,408,033 A | * | 10/1968 | Kochevar et al. | 248/474 |
| 3,984,163 A | | 10/1976 | Boorman, Jr. et al. | |
| 4,135,369 A | | 1/1979 | Allgeyer et al. | |
| 4,523,439 A | * | 6/1985 | Denisot | 62/251 |
| 4,736,997 A | | 4/1988 | Besore et al. | |
| 4,753,084 A | | 6/1988 | Aoki | |
| 4,934,541 A | | 6/1990 | Bussan et al. | |
| 5,964,512 A | | 10/1999 | Borgen | |

FOREIGN PATENT DOCUMENTS

| | | | |
|---|---|---|---|
| DE | 3237502 | * | 3/1984 |
| JP | 5-346285 | | 12/1993 |
| JP | 2001-99533 | | 4/2001 |

OTHER PUBLICATIONS

Japanese Patent Abstract, Publication No. 2002115961 A, dated Apr. 2002, Inventor: Kashiwabuchi Masaaki, Invention: Refrigerator.

* cited by examiner

*Primary Examiner*—James O. Hansen
(74) *Attorney, Agent, or Firm*—Diederiks & Whitelaw, PLC

(57) ABSTRACT

A refrigerator storage arrangement includes a plurality of vertically spaced shelves and a contents viewing system used in connection with enhancing the viewing of food items stored on a rear portion of a lower shelf of the storage arrangement. In accordance with the most preferred form of the invention, the contents viewing system is constituted by a mirror member mounted underneath an upper refrigerator shelf for the purpose of viewing objects located on the lower shelf. The mirror member can take various configurations and may be adjusted through a specified angle range to further enhance the overall viewing arrangement.

14 Claims, 2 Drawing Sheets

REFRIGERATOR CONTENTS VIEWING SYSTEM

BACKGROUND OF THE INVENTION

1. Field of the Invention

The present invention pertains to the art of refrigerators and, more particularly, to a system designed to enhance the viewing of food items stored in select portions of the refrigerator.

2. Discussion of the Prior Art

Increasing the storage capacity of refrigerators has been a specific concern of manufacturers for some time. However, significant restrictions exist in this regard, particularly the need to dimension refrigerators to be received in standard openings. Regardless, certain advancements have been made in the relatively recent past which has enabled the amount of available storage space in a refrigerator to be enlarged. For instance, changes in various design features have resulted in an overall increase in the permissible depth of refrigerator storage compartments.

It is also known to incorporate various types of support members for storing food items within a refrigerator compartment. For instance, it is extremely common to provide a plurality of vertically spaced shelves upon which a wide range of food items can be placed within a refrigerator compartment. Most often, the shelves are vertically adjustable. With the advent of larger refrigerator compartments, the shelves employed therein have correspondingly increased in depth.

Although enlarging the shelf sizes have advantageously provided for a greater amount of storage, it has become increasingly more difficult to view food items stored on rear portions of the shelves. In particular, not only can food items stored along a rear portion of a lower shelf be obscured from view by other food items supported on a front portion of the same shelf, but a view of the rear food items can be significantly obstructed by a shelf positioned above the lower shelf. For this and other reasons, there exists a need in the art for a system used to enhance the viewing of the contents stored along a rear portion of a lower shelf within a refrigerator.

SUMMARY OF THE INVENTION

The present invention is directed to a refrigerator storage arrangement including a plurality of vertically spaced shelves. More specifically, the invention is directed to a system used in connection with viewing food items stored on a rear portion of a lower shelf of the storage arrangement. In accordance with the most preferred form of the invention, a mirror member is mounted underneath an upper refrigerator shelf for the purpose of viewing objects located on the lower shelf. The mirror member can take various shapes, including concave or convex, and may be adjusted through a specified angle range to further enhance the overall viewing system.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
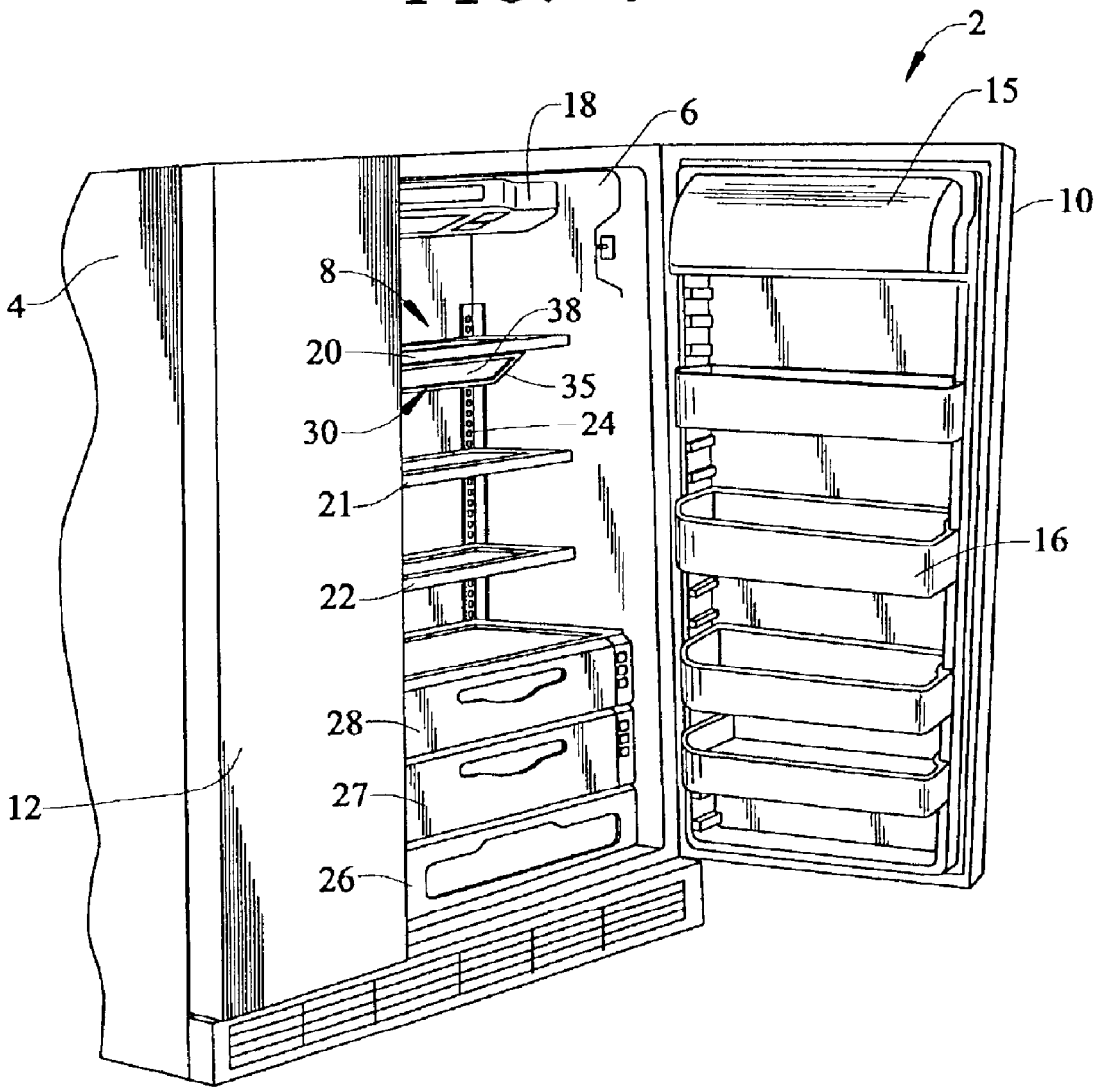
FIG. 1 is a partial, front perspective view of a side-by-side refrigerator incorporating a contents viewing system constructed in accordance with the present invention.

With initial reference to FIG. 1, a refrigerator cabinet 2 includes a shell 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a liner defined freezer compartment (not shown). For the sake of completeness, door 10 of refrigerator cabinet 2 is shown to include a dairy compartment 15 and various vertically adjustable shelving units, one of which is indicated at 16. Mounted in an upper region of fresh food compartment 8 is a temperature control housing 18 which, in a manner known in the art, can be used to regulate the temperature in both fresh food compartment 8 and the freezer compartment. Below temperature control housing 18 are arranged a plurality of vertically spaced shelves 20–22 which are preferably mounted for selective vertical adjustment upon rear rails, one of which is indicated at 24. At a lowermost portion of fresh food compartment 8 is illustrated various slidable bins, i.e., a lowermost bin 26 and higher, individually temperature controlled bins 27 and 28.

To this point, the above-described structure is known in the art and presented only for the sake of completeness. This structure is actually more fully described in U.S. Pat. No. 6,170,276 which is incorporated herein by reference. The present invention is actually directed to the incorporation of a contents viewing system, which is generally indicated at 30, within refrigerator cabinet 2. In general, contents viewing system 30 includes a frame 35 which supports and, most preferably, encapsulates a mirror member 38, i.e. a reflective surface. As will be detailed more fully below, frame 35 can be mounted below a rear portion of one of shelves 20 and 21 in order to enhance the viewing of food items supported upon either shelf 21 or 22 respectively.

Figure 2:
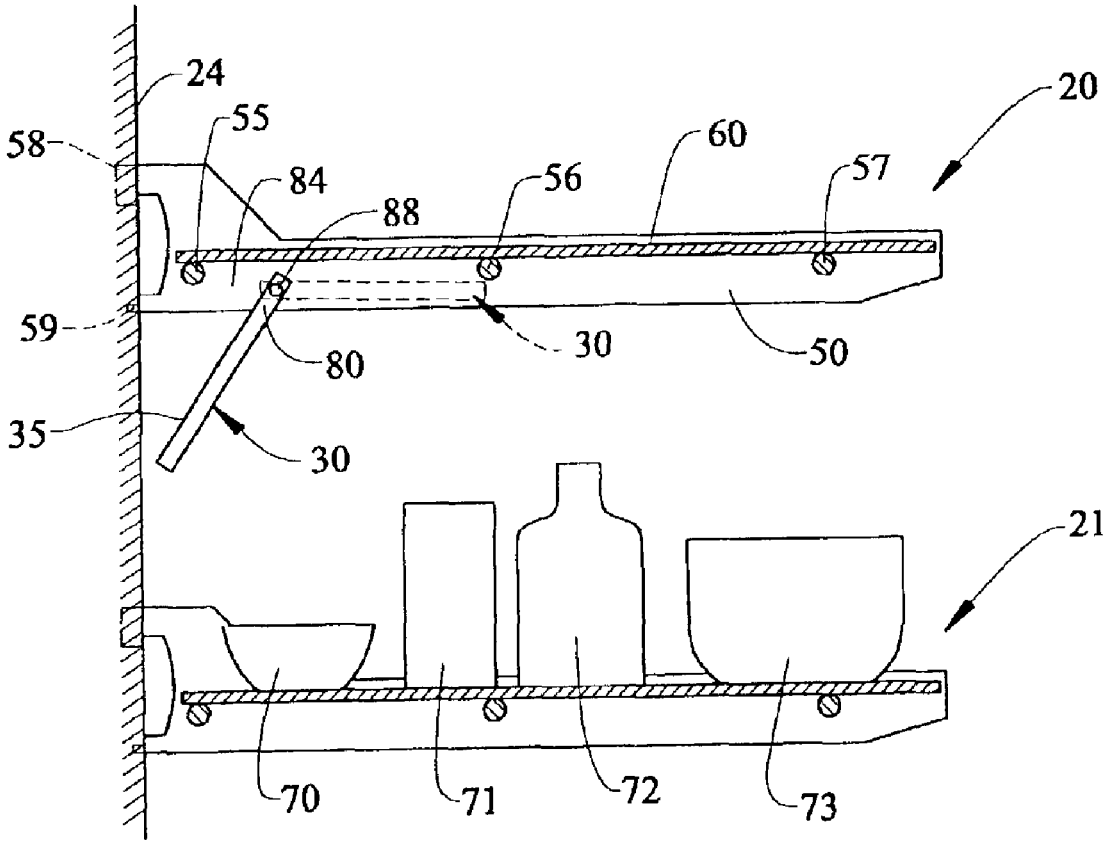
FIG. 2 is an enlarged cross-sectional view of both a shelving assembly and the contents viewing system incorporated in the refrigerator of FIG. 1.

With reference to FIG. 2, each of shelves 20 and 21 includes a pair of spaced side frame members, such as that shown at 50, with the frame members 50 being interconnected by various transverse rails 55–57. Each frame member 50 is shown cantilevered from rails 24 through an upper rear hook member 58 and a lower rear locating member 59. Positioned upon rails 55–57 on each shelf 20, 21 is a planar support member 60 which is preferably constituted by a glass panel. At this point it should be noted that the exact construction of shelves 20–22 can vary considerably without departing from the invention. For example, one or more of shelves 20–22 can equally be constructed in the manner set forth in U.S. Pat. No. 5,947,574, entitled "Refrigerator Shelving Assembly", the disclosure of which is incorporated herein by reference. In any event, for purposes of explaining the present invention, shelf 21 is illustrated to support food items in the form of aligned containers 70–73.

At least due to the vertical spacing between shelves 20 and 21, as well as the relative heights between container 70 and containers 71–73, the visibility of container 70 from the front of refrigerator cabinet 2 upon opening fresh food door 10 can be significantly compromised. However, in accordance with the present invention, contents viewing system 30 is suspended at an angle to the vertical from shelf 20 which enables food items, such as container 70, to be readily visible in mirror member 38. In accordance with the preferred embodiment shown, frame 35 extends transversely between frame members 50 of shelf 20. More specifically, frame 35 includes an upper portion 80 which is pivotally mounted at a rear portion 84 of frame members 50 through pivot pins, one of which is indicated at 88. Most preferably, pivot pins 88 are carried by frame 35 and received within transversely aligned openings in frame members 50.

With this construction, frame 35 of contents viewing system 30 can be pivoted as needed to arrange mirror member 38 at an optimal viewing angle. Therefore, frame 35 can be selectively positioned in a plurality of in-use positions. In addition, frame 35 can be rotated to a recessed, non-use or storage position shown in phantom in FIG. 2. Mirror member 38 can also be shaped to enhance viewing of the contents of fresh food compartment 8, such as by making mirror member 38 concave or convex. Although described with reference to a preferred embodiment of the invention, it should be readily understood that various changes and/or modifications can be made to the invention without departing from the spirit thereof. For instance, contents viewing system 30 can be mounted to a respective shelf 20–22, or even at the back of fresh food compartment 8, in various ways, including in one or more, select fixed positions, such as through the use of a series of detents. In addition, although contents viewing system 30 is preferably employed in fresh food compartment 8, contents viewing system 30 could also be utilized in other compartments or sections of refrigerator cabinet 2. In general, the invention is only intended to be limited by the scope of the following claims.

I claim:

1. A refrigerator comprising:

a cabinet shell;

a liner arranged in the cabinet shell and defining a food compartment;

a pair of shelves mounted at spaced vertical positions within the food compartment so as to define an upper shelf and a lower shelf, each of the upper and lower shelves being adapted to support food items within the refrigerator; and a contents viewing system including a mirror member which is suspended from a lower rear portion of the upper shelf, extends toward the lower shelf, and is angled with respect to a vertical, wherein food items stored on a rear portion of the lower shelf are viewable through the mirror member.

2. The refrigerator according to claim 1, wherein the mirror member is movably attached to the upper shelf.

3. The refrigerator according to claim 2, wherein the mirror member is pivotally attached to the upper shelf.

4. The refrigerator according to claim 3, wherein the contents viewing system further includes a frame surrounding the mirror member, said frame being directly, pivotally attached to the upper shelf.

5. The refrigerator according to claim 2, wherein the mirror member is movable between in-use and non-use positions.

6. The refrigerator according to claim 5 wherein, when in the non-use position, the mirror member is recessed beneath the upper shelf.

7. In a refrigerator including a cabinet shell within which is defined a food compartment incorporating at least upper and lower shelves for supporting food items within the refrigerator, a contents viewing system comprising:

a frame pivotally attached to a lower rear portion of the upper shelf and extending towards the lower shelf; and a mirror member supported by the frame, wherein the frame member can be selectively angled to enable food items stored on a rear portion of the lower shelf to be viewable through the mirror member.

8. The contents viewing system according to claim 7, wherein the mirror member is movable between in-use and non-use positions.

9. The contents viewing system according to claim 8 wherein, when in the non-use position, the mirror member is recessed beneath the upper shelf.

10. A refrigerator comprising:

a cabinet shell;

a liner arranged in the cabinet shell and defining a food compartment;

a pair of shelves mounted at spaced vertical positions within the food compartment so as to define an upper shelf and a lower shelf, each of the upper and lower shelves being adapted to support food items within the refrigerator; and mirror means adjustably attached to the upper shelf for viewing food items stored on a rear portion of the lower shelf.

11. The refrigerator according to claim 10, wherein the mirror means is pivotally attached to the upper shelf.

12. The refrigerator according to claim 11, wherein the mirror means includes a frame surrounding a mirror member, said frame being directly, pivotally attached to the upper shelf.

13. The refrigerator according to claim 10, wherein the mirror means is movable between in-use and non-use positions.

14. The refrigerator according to claim 13 wherein, when in the non-use position, the mirror means is recessed beneath the upper shelf.

* * * * *